United States Patent [19]

Yoda

[11] Patent Number: 4,829,787

[45] Date of Patent: May 16, 1989

[54] ORNAMENTAL ARTICLE

[76] Inventor: Mitsuhiro Yoda, 4-1-106, Izumicho 3 chome, Kokubunji-shi, Tokyo, Japan

[21] Appl. No.: 865,515

[22] Filed: May 21, 1986

[30] Foreign Application Priority Data

Aug. 27, 1985 [JP] Japan ..... 60-129526

[51] Int. Cl.[4] ..... A44C 5/00; A44C 5/04

[52] U.S. Cl. ..... 63/3; 63/5.1

[58] Field of Search ..... 63/3, 4, 15.45, 26, 63/32, 5 R; 59/80, 82, 79.1, 83, 84

[56] References Cited

U.S. PATENT DOCUMENTS

| | | | |
|---|---|---|---|
| 272,829 | 2/1883 | Cockshaw | 63/3 |
| 430,295 | 6/1890 | Mathewson | 63/3 |
| 1,522,297 | 1/1925 | Godsol . | |
| 1,711,848 | 5/1929 | Heitkemper | 24/123 |
| 1,841,375 | 1/1932 | Meyer | 63/3 |
| 1,894,195 | 1/1933 | Pulver | 63/28 |
| 3,685,284 | 8/1972 | Taubner, Jr. | 63/4 |
| 4,237,702 | 12/1980 | Caverly | 63/31 |

FOREIGN PATENT DOCUMENTS 57-60341 12/1982 Japan .

*Primary Examiner*—Robert A. Hafer
*Assistant Examiner*—Michael Brown
*Attorney, Agent, or Firm*—Scherlacher, Mok & Roth

[57] ABSTRACT

An ornamental article such as a pearl necklace has a plurality of gem objects each having a spherical surface and a through hole extending substantially perpendicularly to the spherical surface, a string threaded through the gem objects to interconnect them, and a plurality of spacers of an elastomeric material interposed between adjacent ones of the gem objects and having through holes through which the string extends. Each of the spacers has a thicker central portion and a thinner outer circumferential edge. The spherical surface of each of the adjacent gem objects has a radius of curvature of r. The thicker central portion having a thickness of at most 0.4r, each spacer having a radius of at most 0.77r. With this arrangement, the gem objects can easily be threaded on the string. The string is prevented from being subjected to undue tension even when bent strongly, so that the string and the gem objects are projected against damage in use or sale.

9 Claims, 6 Drawing Sheets

ORNAMENTAL ARTICLE

BACKGROUND OF THE INVENTION

The present invention relates to an ornamental article comprising a multiplicity of gem objects interconnected by a string passing through holes defined in the gem objects. The present invention is applicable to annular ornamental articles such as a necklace, a pendant, a bracelet, a hair band, a string of beads, an anklet ring, and the like.

The term "gem objects" used throughout the specification means precious stones, semiprecious stones, pearls, pieces of coral, amber, tortoise shell, and ivory, synthetic stones, imitation stones, and precious metals.

The gem objects, when finished, are generally of a spherical shape or in the form of a particulate body or small mass having a spherical surface.

FIG. 7 of the accompanying drawings illustrates three spherical gem objects 1*a*, 1*b*, 1*c* having respective through holes through which a string 2 passes. Each of the gem objects has a radius r. The length L of the string 2 which is inserted in the three gem objects is therefore equal to 6 r.

These strung gem objects are generally used as a necklace, for example, in an annular or arcuate form and worn by the user. When in use, the string 2 is subjected to a strong tensile force.

FIG. 8 shows the manner in which the three strung gem objects are used in an arcuate form. It is empirically known that the maximum angle through which adjacent two of the strung gem objects are angularly displaced, or the string is bent, when the chain of the gem objects flexes, is 45 degrees. This requires manufacturers of ornamental articles to thread the gem objects on the string so that they can withstand damaging stresses even when two adjacent gem objects are angularly displaced through 45 degrees. Stated otherwise, the strung gem objects are practically usable sufficiently if they can withstand stresses arising from bending through 45 degrees. However, there are some technical difficulties in meeting the above requirement.

More specifically, unless the string 2 is tensioned to an appropriate extent under the condition of FIG. 7, there are gaps formed between the gem objects 1*a*, 1*b*, 1*c*, making the overall chain unsightly and lowering its commercial value.

If the string 2 is kept under suitable tension in FIG. 7, the string 2 tends to be excessively tensioned and at times cut off or elongated when bent as shown in FIG. 8. The unduly tensioned string 2 imposes localized forces on ends of the hole of the gem object, with the result that the ends of the hole of the gem object are highly likely to be damaged especially when the gem objects are easily damageable pieces such as pearls. Therefore, the procedure for threading gem objects requires much skill on the part of the worker who assembles chains of gem objects. Furthermore, the string used is limited in terms of material and performace. Even if a chain of gem objects is assembled with the required degree of skill and a desired string, the string is still apt to rupture when the chain of gem objects is strongly bent over or caused to flex.

As disclosed in Japanese Utility Model Publication No. 57(1982)-60341, there is known an ornamental article design in which an elastomeric spacer is placed as a spring member between two adjacent gem objects. With this conventional arrangement, when the chain of interconnected gem objects is bent over, the string on which the gem objects are threaded is excessively tensioned, and tends to be cut off or elongated. The gem objects are also prone to damage since undue localized forces are imposed on ends of the holes in the gem objects. More specifically, as shown in FIG. 10, two spherical gem objects 1*a*, 1*b* each of a radius r are interconnected by a string 2 with a flat spacer 9 of a thickness s being interposed between the gem objects 1*a*, 1*b*. While the string 2 remains straight as indicated by the solid line, the distance L between the centers of the two gem stones 1*a*, 1*b* is expressed by $L=2r+s$. When the string 2 is bent over as indicated by the dot-and-dash line, the distance L′ between the centers of the gem stones 1*a*, 1*b* is expressed by $L'=2r+s+2l''$, which is greater than the distance L by $2l''$. As a consequence, the string 2 is pulled under a force commensurate with $2l''$, and the reactive force produced by the string 2 acts on the gem objects.

SUMMARY OF THE INVENTION

It is an object of the present invention to provide a ornamental article of strung gem objects which can easily be threaded on a string and is so designed that no excessive tensile forces will be applied to the string even when the article is strongly bent over, for protection of the string and the gem objects against damage.

According to the present invention, the above object can be achieved by an ornamental article comprising a plurality of gem objects each having a spherical surface and a through hole extending substantially perpendicularly to the spherical surface, a string threaded through the gem objects to interconnect them, and a plurality of spacers of an elastomeric material interposed between adjacent ones of the gem objects and having through holes through which the string extends, each of the spacers having a thicker central portion and a thinner outer circumferential edge, the spherical surface of each of the adjacent gem objects having a radius of curvature of r, the thicker central portion having a thickness of at most 0.4r, each spacer having a radius of at most 0.77r.

The above and further objects, details and advantages of the present invention will become apparent from the following detailed description of preferred embodiments thereof, when taken in conjunction with the accompanying drawings.

DETAILED DESCRIPTION OF THE PREFERRED EMBODIMENTS

Figure 9:
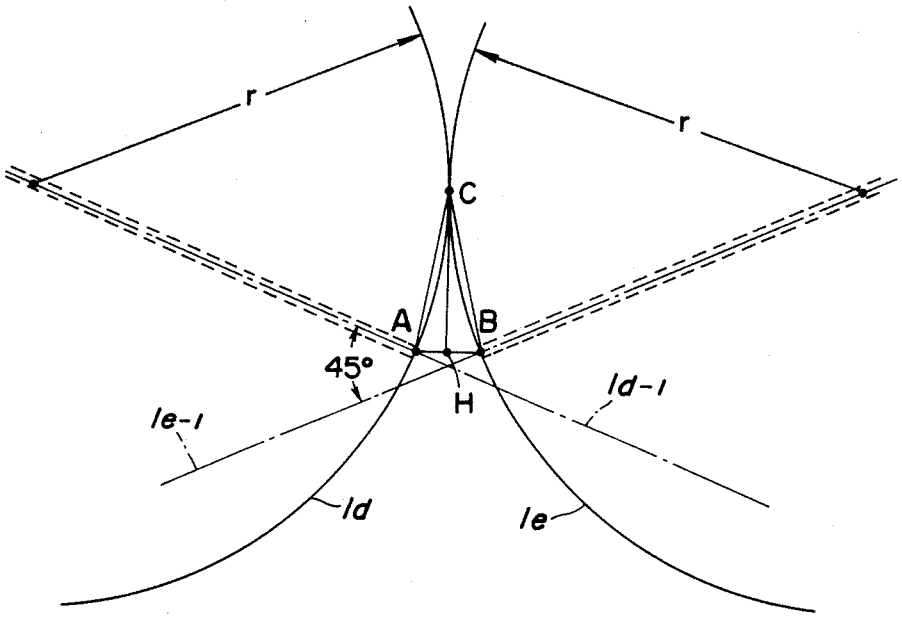
FIG. 9 is a schematic view illustrative of the principles of the present invention.
Figure 10:
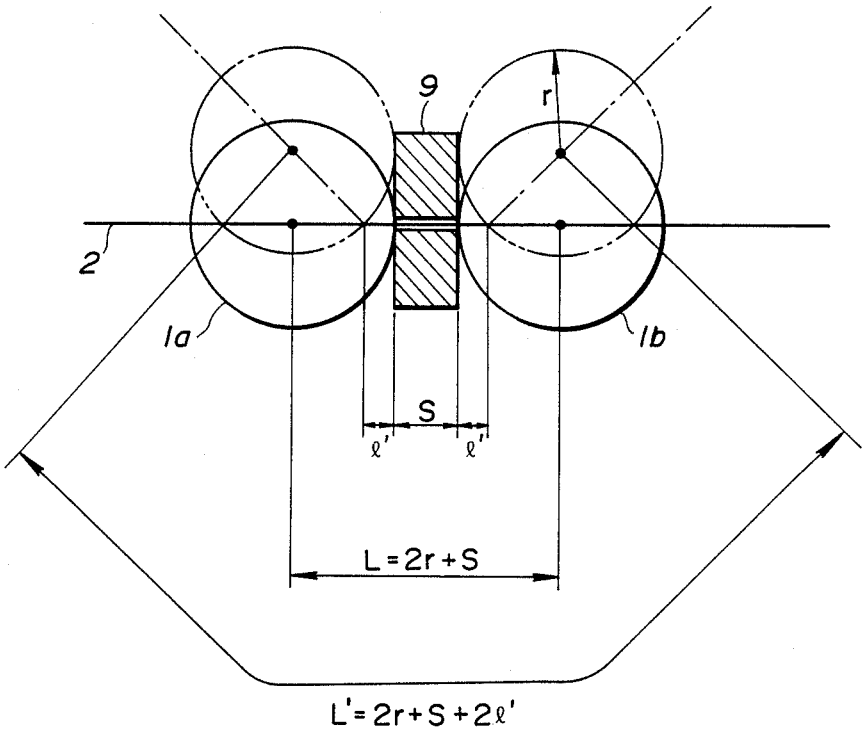
FIG. 10 is a schematic view explanatory of problems of another conventional ornamental article.

FIG. 9 shows the principles of the present invention. Two small spherical gem objects 1*d*, 1*e* each having a radius r are angularly displaced so that the through holes in the gem objects 1*d*, 1*e* have their central axes 1*d*-1, 1*e*-1 intersecting at 45 degrees. The through holes have exit ends A, B, respectively. The gem objects 1*d*, 1*e* are held in contact with each other at a point C.

A perpendicular from the point C to a line AB has a foot H. At this time, AB=0.4r and CH=0.77r.

Where a thin abacus-bead-shaped member is interposed between the gem objects 1*d*, 1*e* as a spacer between the points A, B, the spacer would prevent the strung ornamental article from flexing unless the spacer had a thickness of 0.4r or smaller and a radius of 0.77r.

The string threaded through the gem objects 1*d*, 1*e* can be kept at constant tension without preventing the strung ornamental article from flexing, by placing, between the gem objects 1*d*, 1*e*, an elastomeric thin abacus-bead-shaped spacer having a thickness of 0.4r or smaller and a radius of 0.77r or smaller.

Figure 1:
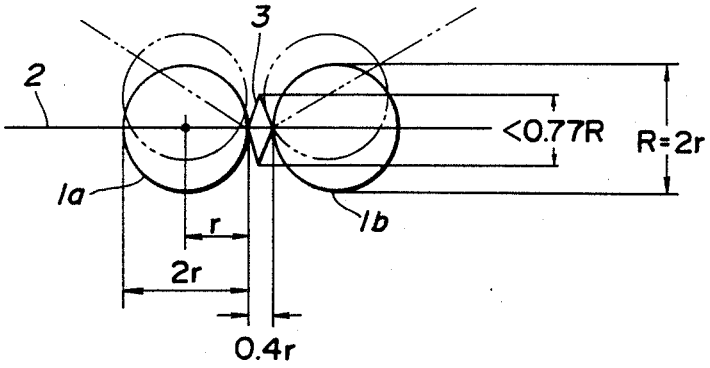
FIG. 1 is a schematic view of an ornamental article according to an embodiment of the present invention.

FIG. 1 shows an ornamental article according to an embodiment of the present invention. The ornamental article has a multiplicity of spherical gem objects threaded on a string 2. Only adjacent two 1*a*, 1*b* out of the strung gem objects are illustrated in FIG. 1, the gem objects 1*a*, l*b* each having a radius r. A thin abacus-bead-shaped spacer 3 made of rubber is interposed between the gem objects 1*a*, 1*b* and threaded on the string 2. The spacer 3 has a maximum thickness of 0.4r and a radius of 0.77r or less. Assuming that each of the gem objects 1*a*, 1*b* has a diameter R, the diameter of the spacer 3 is 0.77 R or smaller. However, it is preferable that the radius of the spacer 3 be 0.4r or less to make the spacer 3 less conspicuous. The spacer 3 is required to be thicker in its central portion and thinner in its outer circumferential edge.

With the ornamental article thus constructed as shown in FIG. 1, the spacer 3 serves to keep the string 2 under substantially constant tension without preventing the ornamental article from flexing even when the gem objects 1*a*, 1*b* are angularly displaced or bent as indicated by the imaginary lines.

Where the outer profile of the spacer is defined by straight lines AC, BC in FIG. 9, it physically interferes with arcs AC, BC. By constructing the spacer 3 of rubber, however, such physical interference can be absorbed by elastic deformation and displacement of the spacer 3.

Figure 2:
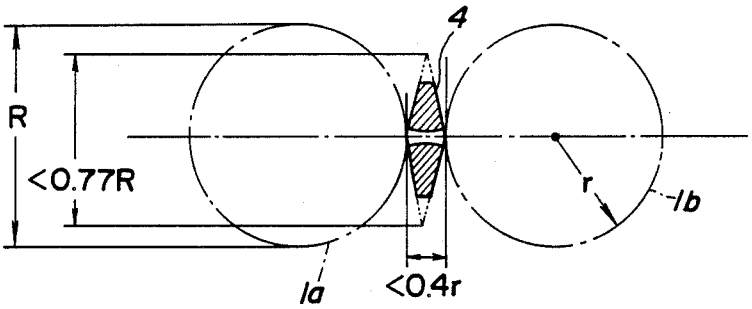
FIGS. 2 through 6 are schematic views of ornamental articles according to other embodiments of the present invention.

FIG. 2 shows another embodiment of the present invention. A spacer 4 interposed between the gem objects 1*a*, 1*b* has its circumferential edge cut off or chamferred. The spacer 4 has a central hole with its open ends enlarged for facilitating the threading of the string therethrough.

Figure 3:
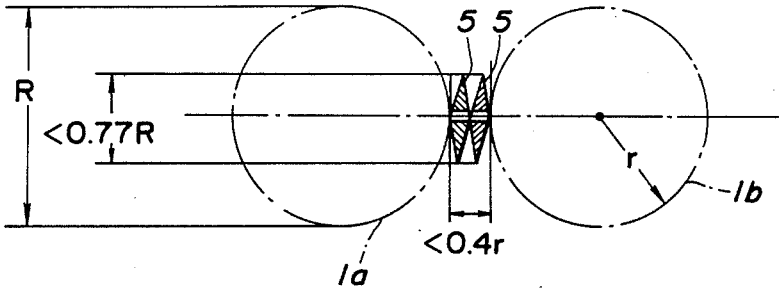

According to still another embodiment shown in FIG. 3, two spacers 5 are placed side by side between the gem objects 1*a*, 1*b*. The combined thickness of the two spacers 5 is selected to be 0.4r or less.

Figure 4:
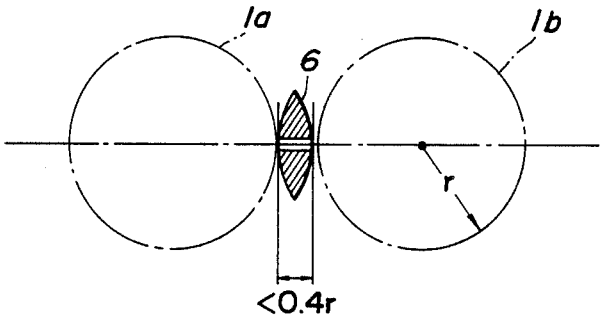

FIG. 4 illustrates an ornamental article according to a still further embodiment of the present invention. A spacer 6 interposed between the gem objects 1*a*, 1*b* is shaped like a double-convex lens.

Figure 5:
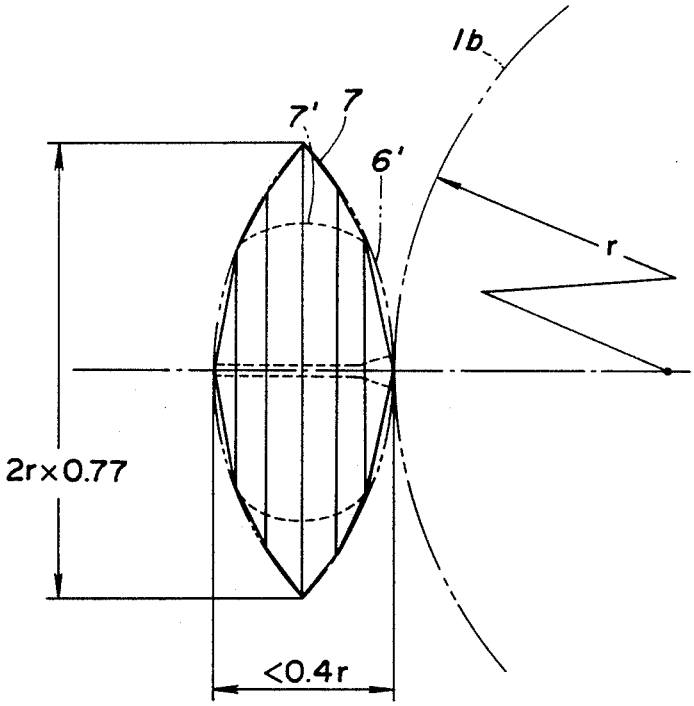

FIG. 5 shows a modification of the ornamental article of FIG. 4. A spacer 7 is constructed of a combination of conical and frustoconical layers having an outer profile inscribed in a reference surface 6′ (indicated by the imaginary lines) of a double-convex-lens form. The outer circumferential edge of the spacer 7 may be cut off or chamfered as indicated by the dotted lines 7′.

Where the two gem objects between which a spacer is to be interposed have different radii, no practical problems would arise by calculating the dimensions of the spacer based on the arithmetic mean of the radii of the gem objects.

Figure 6:
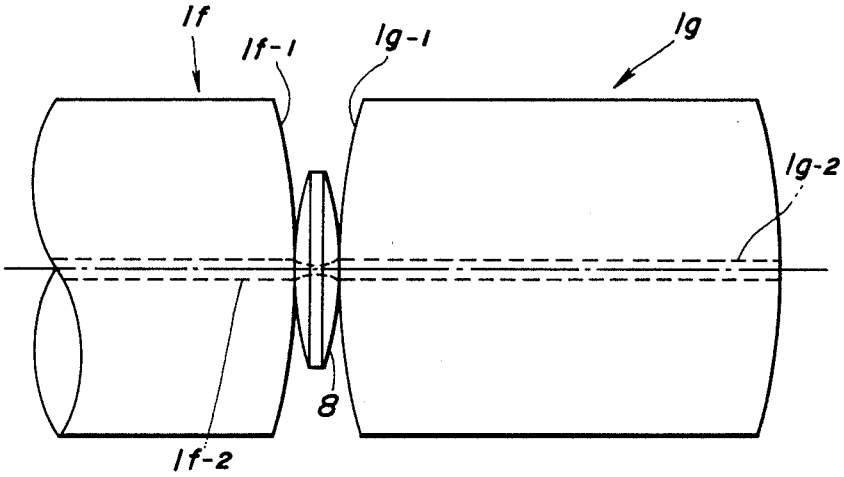
Figure 7:
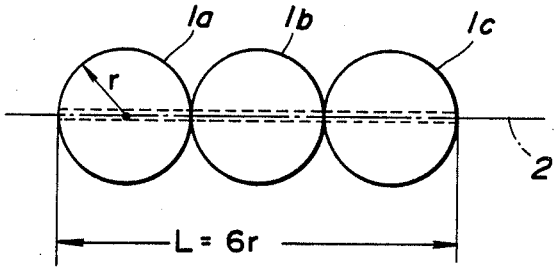
FIGS. 7 and 8 are schematic views explanatory of problems associated with a conventional ornamental article.
Figure 8:
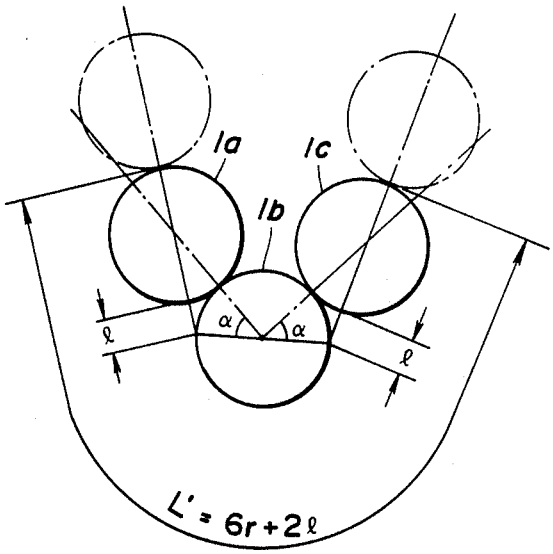

According to still another embodiment shown in FIG. 6, gem objects 1*f*, 1*g* are substantially cylindrical in shape and have respective end surfaces 1*f*-1, 1*g*-1 which are near-plane spherical surfaces (their radii of curvature are quite large). The gem objects 1*f*, 1*g* have respective through holes 1*f*-2, 1*g*-2 through which a string is inserted, the holes 1*f*-2, 1*g*-2 extending substantially perpendicularly to the spherical surfaces 1*f*-1, 1*g*-1. A spacer 8 interposed between the gem objects 1*f*, 1*g* is of a double-convex shape with its outer circumferential edge chamfered.

The ratio of the number of spacers to the number of gem objects, and the positions where the spacers are placed may be varied to enable the spacers to function properly.

With the arrangement of the present invention, gem objects can easily be threaded on a string without requiring much skill on the part of the worker. Even when the strung ornamental article is caused to flex, the string is kept under substantially constant tension without the danger of getting broken, elongated, or loosened. Since the string is prevented from being cut off, elongated, or loosened, undesirable accidents are reduced during use or in sale. Therefore, the ornamental article of the invention is highly effective for greater consumer protection and smoother distribution in the gem market. Inasmuch as the string is not subjected to strong tensile forces, a range of strings that can be used is widened, i.e., more and less stretchable strings can be employed. In the absense of undue tensile forces on the string, the strung gem objects are of higher durability as they are free of damage which would otherwise arise from undue tension of the string.

Although there have been described what are at present considered to be the preferred embodiments of the present invention, it will be understood that the invention may be embodied in other specific forms without departing from the spirit or essential characteristics thereof. The present embodiments are therefore to be considered in all aspects as illustrative, and not restrictive. The scope of the invention is indicated by the appended claims rather than by the foregoing description.

I claim:

1. An ornamental article comprising:

a plurality of objects each having a spherical outer surface defined by a radius r and a first aperture means defining an aperture extending through each object substantially perpendicular to said spherical outer surface;

string means threaded through the first aperture means for interconnecting the objects; and a plurality of generally discus shaped spacers each spacer having an axis and a circular perimeter defined by a radius transverse to the axis and a central portion having a maximum thickness measured along the axis; and a second aperture means defining an aperture extending through the central portion along the axis for receiving the string means, at least one spacer interposed between adjacent objects, and wherein the perimeter radius measured from the axis is no greater than 0.77r and the maximum thickness is no greater than 0.4r.

2. An ornamental article according to claim 1, wherein each of said spacers is formed of elastomeric material.

3. An ornamental article according to claim 2, wherein each of said spacers is chamfered at its perimeter.

4. An ornamental article according to claim 3, wherein the second aperture means is enlarged at its extremities.

5. An ornamental article according to claim 1, wherein two of said spacers are interposed side by side between said adjacent objects.

6. An ornamental article according to claim 1, wherein each of said spacers if double-convex in shape.

7. An ornamental article according to claim 1, wherein each of said spacers has opposite facing surfaces each facing surface segmented into a series of surface regions, the outermost region having a conical profile, the remaining regions each having a frusto-conical profile, the facing surfaces being inscribed in a reference surface of a double-convex form.

8. An ornamental article according to claim 6, wherein each of said spacers is chamfered at its perimeter.

9. An ornamental article according to claim 1, wherein each of said objects is substantially cylindrical in shape and having spherically shaped end surfaces.

* * * * *

UNITED STATES PATENT AND TRADEMARK OFFICE

CERTIFICATE OF CORRECTION

PATENT NO. : 4,829,787

DATED : May 16, 1989

INVENTOR(S) : Mitsuhiro Yoda

It is certified that error appears in the above-identified patent and that said Letters Patent is hereby corrected as shown below:

Column 4, line 56, between "means" and "interconnecting", delete "for".

Column 4, line 63, after "axis", delete "for".

Signed and Sealed this

Thirty-first Day of October, 1989

*Attest:*

DONALD J. QUIGG

*Attesting Officer*

*Commissioner of Patents and Trademarks*